US006774091B2

(12) United States Patent
Dituro et al.

(10) Patent No.: US 6,774,091 B2
(45) Date of Patent: Aug. 10, 2004

(54) LUBRICANT AND ADDITIVE FORMULATION

(75) Inventors: Michael A. Dituro, Huntington, WV (US); Richard J. Baumgart, Paris, KY (US); Frances E. Lockwood, Georgetown, KY (US)

(73) Assignee: Ashland Inc., Lexington, KY (US)

( * ) Notice: Subject to any disclaimer, the term of this patent is extended or adjusted under 35 U.S.C. 154(b) by 0 days.

(21) Appl. No.: 10/206,852

(22) Filed: Jul. 26, 2002

(65) Prior Publication Data

US 2003/0087769 A1 May 8, 2003

Related U.S. Application Data

(63) Continuation-in-part of application No. 09/520,738, filed on Mar. 7, 2000, now abandoned, which is a continuation-in-part of application No. 08/836,083, filed on Aug. 27, 1997, now Pat. No. 6,034,038.

(51) Int. Cl.[7] ..... C10M 141/12

(52) U.S. Cl. ..... 508/168; 508/167; 508/181; 508/185; 508/371; 508/379; 508/496; 508/499; 508/591

(58) Field of Search ..... 508/185, 168

(56) References Cited

U.S. PATENT DOCUMENTS 5,458,807 A * 10/1995 Tamoto ..... 508/192
5,629,272 A * 5/1997 Nakazato et al. ..... 508/185
5,739,088 A * 4/1998 Inoue et al. ..... 508/156
5,962,377 A * 10/1999 Baumgart et al. ..... 508/168
6,034,038 A * 3/2000 Lockwood et al. ..... 508/183
6,423,670 B2 * 7/2002 Locke et al. ..... 508/192

* cited by examiner

*Primary Examiner*—Ellen M McAvoy
(74) *Attorney, Agent, or Firm*—Carrithers Law Office, PLLC; David W. Carrithers

(57) ABSTRACT

A lubricant additive formulation for increasing the performance of conventional engine lubricants for use as an engine treatment oil additive formulated for addition to conventional motor oil to improve the lubricating properties of the engine oil and enhance the performance of the engine. A preferred embodiment of the engine treatment oil additive comprises a blend of chemical constituents including a base stock selected from a synthetic base stock, a mineral oil base stock, and a severely hydrocracked base stock or combinations thereof, an oil soluble molybdenum additive, dispersant inhibitor, and selected additives such as polytetrafluoroethylene, viscosity index improvers, and extreme pressure wear agent used in combination with a conventional crankcase lubricant at about a 20 to about a 25% volume/percent or as a complete motor oil. Additional components may be added to the engine treatment oil additive formulation to enhance specific properties for special applications.

38 Claims, 6 Drawing Sheets

LUBRICANT AND ADDITIVE FORMULATION

This is a Continuation-In-Part application of Ser. No. 09/520,738 filed on Mar. 7, 2000, now abandoned, which is a Continuation-In-Part of application Ser. No. 08/836,083 filed on Aug. 27, 1997 now U.S. Pat. No. 6,034,038, both of which are incorporated by reference herein. This application also claims priority and incorporates by reference: U.S. Pat. Nos. 6,034,038 which issued in March of 2000; 5,962,377 which issued on Oct. 5, 1999; 5,763,369 which issued in June of 1998; and 5,641,731 issued in June of 1997.

BACKGROUND OF THE INVENTION

1. Technical Field

The invention relates to the general field of additives to improve the performance of lubricating oils and function as an engine treatment oil additive and/or complete motor oil lubricant. A preferred embodiment of the present invention comprises effective amounts of a combination of chemical constituents including an oil soluble molybdenum additive, base oil (synthetic, mineral, and/or Group III semi-synthetics), a dispersant inhibitor containing zinc dithiophosphate, and viscosity index improvers. Addition of selected synthetics such as polyalphaolefin and/or esters such as a diester or polyolester, and/or a nonaqueous polytetrafluoroethylene compound, and/or a antiwear/extreme pressure agent such as a metal containing borate compound such as a borate ester, may be used to formulate one or more embodiments of the additive in combination with a conventional crankcase lubricant containing mineral oil, synthetic oil, semi-synthetic, or combinations thereof up to 50 volume percent and more preferably from about 10 to 40 volume percent, more preferably from about 15 to 30 percent and most preferably from about 20 to about a 25% volume/percent after dilution with motor oil, wherein typically 1 quart is blended with 4 or 5 quarts of motor oil. The various constituents are preblended and/or sold as a complete motor oil formulation.

2. Description of the Prior Art

Lubrication involves the process of friction reduction, accomplished by maintaining a film of a lubricant between surfaces which are moving with respect to each other. The lubricant prevents contact of the moving surfaces, thus greatly lowering the coefficient of friction. In addition to this function, the lubricant also can be called upon to perform heat removal, containment of contaminants, and other important functions. Additives have been developed to establish or enhance various properties of lubricants. Various additives which are used include viscosity improvers, detergents, dispersants, antioxidants, extreme pressure additives, and corrosion inhibitors.

Anti-wear agents, many of which function by a process of interactions with the surfaces, provide a chemical film which prevents metal-to-metal contact under high load conditions. Wear inhibitors which are useful under extremely high load conditions are frequently called "extreme pressure agents". Certain of these materials, however, must be used judiciously in certain applications due to their property of accelerating corrosion of metal parts, such as bearings. The instant invention utilizes the synergy between several chemical constituents to provide an additive formula which enhance the performance of conventional engine oil and inhibits the undesirable side effects which may be attributable to use of one of more of the chemical constituents when used at particular concentrations.

Several references teach the use of individual chemical components to enhance the performance of conventional engine oil. For instance, U.S. Pat. No. 4,879,045 by Eggerichs adds lithium soap to a synthetic base oil comprising diester oil and polyalphaolefins which can comprise an aliphatic diester of a carboxylic acid such as di-2-ethylhexylazelate, di-isodecyladipate, or ditridecyladipate, as set forth in the *Encyclopedia of Chemical Technology*, 34th addition, volume 14, pp 477–526, which describes lubricant additives including detergent-dispersant, viscosity index (VI) improvers, foam inhibitors, and the like.

U.S. Pat. No. 4,333,840 to Reick teaches a hybrid PFTE lubricant and describes an optional addition of a molybdenum compound in a carrier oil. It uses a carrier oil diluted by a synthetic lubricant of low viscosity in order to provide a viscosity that is "acceptable in weapons applications". The formulations are suggested for lubricating skis or weapons; however, there is no suggestion that they are applicable to lubrication of internal combustion engines in combination with the constituents of the present claimed invention. U.S. Pat. No. 4,349,444 by Reich teaches the use of fluorochemical surface active agents or surfactants to stabilize an aqueous dispersion of colloidal PTFE particles, which Applicant believes would tend to be corrosive and undesirable in an engine lubricating oil.

Furthermore, U.S. Pat. Nos. 4,615,917 and 4,608,282 by Runge teach blending sintered fluoropolymer (e.g., PTFE) with solvents which evaporate to leave a thin film when the formulation is sprayed or applied as a grease to a metal surface, e.g., boat hulls, aircraft, dissimilar metals.

SUMMARY OF THE INVENTION

The present invention comprises various formulations of lubricant additive concentrates for addition to conventional engine oil or as motor oil lubricants incorporating said additives therein as complete formulas for improving the lubricating properties of the engine oil, enhance the performance of the engine, and reduce engine wear and possibly reduce the consumption of the oil.

One preferred embodiment of the engine treatment oil additive comprises a blend of chemical constituents including an oil soluble molybdenum additive, a dispersant inhibitor containing zinc dithiophosphate, and a viscosity index improvers in a synthetic base stock such as a polyalphaolefin. A selected synthetic constituent comprising a ester such as a diester, and/or a polyolester, provides optimal performance characteristics to the composition. The composition may include a mineral oil or a Group III hydrogenated oil as an additive to the base formula. A nonaqueous polytetrafluoroethylene compound may be added to further improve the lubricity of the composition. A metal containing a high pressure antiwear agent such as a borate compound and preferably a borate ester may be added optionally as a corrosion inhibitor for yellow metals. The constituents may be combined to give particularly performance properties for formulating various embodiments of the lubricant additive concentrate for use with conventional crankcase engine oil or the formulation of a complete engine oil incorporating the additive concentrate package.

The additive is used in combination with a conventional crankcase lubricant containing mineral oil, synthetic oil or combinations thereof up to about 50 percent by volume, more preferably from about 10 to 40 percent by volume, more preferably from 15 to 30 percent by volume, and most preferably from about 20 to about a 25% volume/percent.

Another preferred embodiment of the engine treatment oil additive comprises a blend of chemical constituents including an oil soluble molybdenum additive, a synthetic, mineral, or Group III semi-synthetic base oil. Moreover, a dispersant inhibitor containing zinc dithiophosphate, polytetrafluoroethylene, and viscosity index improvers are blended together and added thereto. An extreme pressure antiwear agent such as a borate compound may also be utilized in the present composition.

The improved performance of the engine additive in comparison with conventional crankcase lubricants is attributable to optimizing the design parameters for each of the individual chemical constituents and combining the chemical constituents to obtain surprisingly good results including improved: wear, oxidation resistance, viscosity stability, engine cleanliness, fuel economy, cold starting, reduced oil consumption, and inhibition of acid formation. The novel engine additive formulation comprises a combination of compounds, ingredients, or components, each of which alone is insufficient to give the desired properties, but when used in concert give outstanding lubricating properties. Additional components may be added to the engine additive formulation to enhance specific properties for special applications. Moreover, the formulation is compatible with engine warranty requirements, i.e., service classification API SH and SJ.

The lubricating and oil-based functional fluid compositions of the present invention are based on natural and synthetic lubricating oils and mixtures thereof in combination with the additives.

The individual components can be separately blended into the base fluid or can be blended therein in various subcombinations. Moreover, the components can be blended in the form of separate solutions in a diluent. Blending the components used in the form of an oil additive concentrate simplifies the blending operations, reduces the likelihood of blending errors, and takes advantage of the compatibility and solubility characteristics afforded by the overall concentrate. Of course, the preblended complete motor oil is convenient to use and is often preferable for adding to an engine one quart or less at a time such as for routine maintenance of older cars having engine wear and requiring additional motor oil lubricant between oil changes. The complete motor oil does not require the consumer to determine the amount of additive required for optional performance when blending with a conventional motor oil in small quantifies between oil changes.

The combination of chemical constituents of the present invention are not disclosed by any known prior art references. The incorporation of molybdenum compounds, extreme antiwear compounds such as boric acid agents and/or a PFTE lubricant provide improved performance to motor oil and greases. Moreover, the incorporation of semi-synthetic oils defined by the American Petroleum Institute (API) as severely hydro cracked oils) provide an means to reduce the cost of lubricating oils while maintaining many of the desirable characteristics of synthetic oil.

These lubricating compositions are effective in a variety of applications including crankcase lubricating oils for spark-ignited and compression-ignited internal combustion engines, two-cycle engines, aviation piston engines, marine and low-load diesel engines, and the like. The invention will find use in a wide variety of lubricants, including motor oils, greases, sucker-rod lubricants, cutting fluids, and even spray-tube lubricants. The invention has the multiple advantages of saving energy, reducing engine or other hardware maintenance and wear, and therefore, provides an economical solution to many lubricating problems commonly encountered in industry or consumer markets. It is also contemplated that the formulation may be applicable to automatic transmission fluids, transaxle lubricants, gear lubricants, hydraulic fluids, and other lubricating oil compositions which can benefit from the incorporation of the compositions of the instant invention.

More particularly, one preferred concentrate for addition to conventional motor oil for improving the lubricating properties of the motor oil and enhancing the performance of the engine comprises the following chemical constituents: an oil soluble molybdenum additive, a ("synthetic base") such as polyalphaolefin (PAO), a synthetic polyolester, and/or a synthetic diester, a Dispersant Inhibitor (DI) package containing zinc dithiophosphate (ZDP) and which may also contain a detergent and/or corrosion inhibitor, such as CHEMALOY D-036; a Mineral Oil Base Stock; and a Viscosity Index Improver, such as for example, (SHELLVIS 90-SBR); and an extreme anti-wear agent (borate ester). The addition of a nonaqueous polytetrafluoroethylene, ("PTFE") provides additional protection and increased performance characteristics.

Finally, a preferred composition of the instant invention provides improved lubricating properties and comprises a lubricant concentrate for dilution with conventional, synthetic blend, and/or fully synthetic motor oil comprising in combination: an effective amount of an oil soluble molybdenum additive; an effective amount of a base oil selected from the group consisting of a synthetic base oil, a mineral oil, a severely hydro cracked oil, alone and in combination one with another; and an effective amount of less than 1000 ppm of an elemental boron. Moreover, a lubricating composition comprising a major amount of an oil of lubricating viscosity and a minor amount of the concentrate aforementioned concentrate additive provides a complete motor oil with improved lubricating properties.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
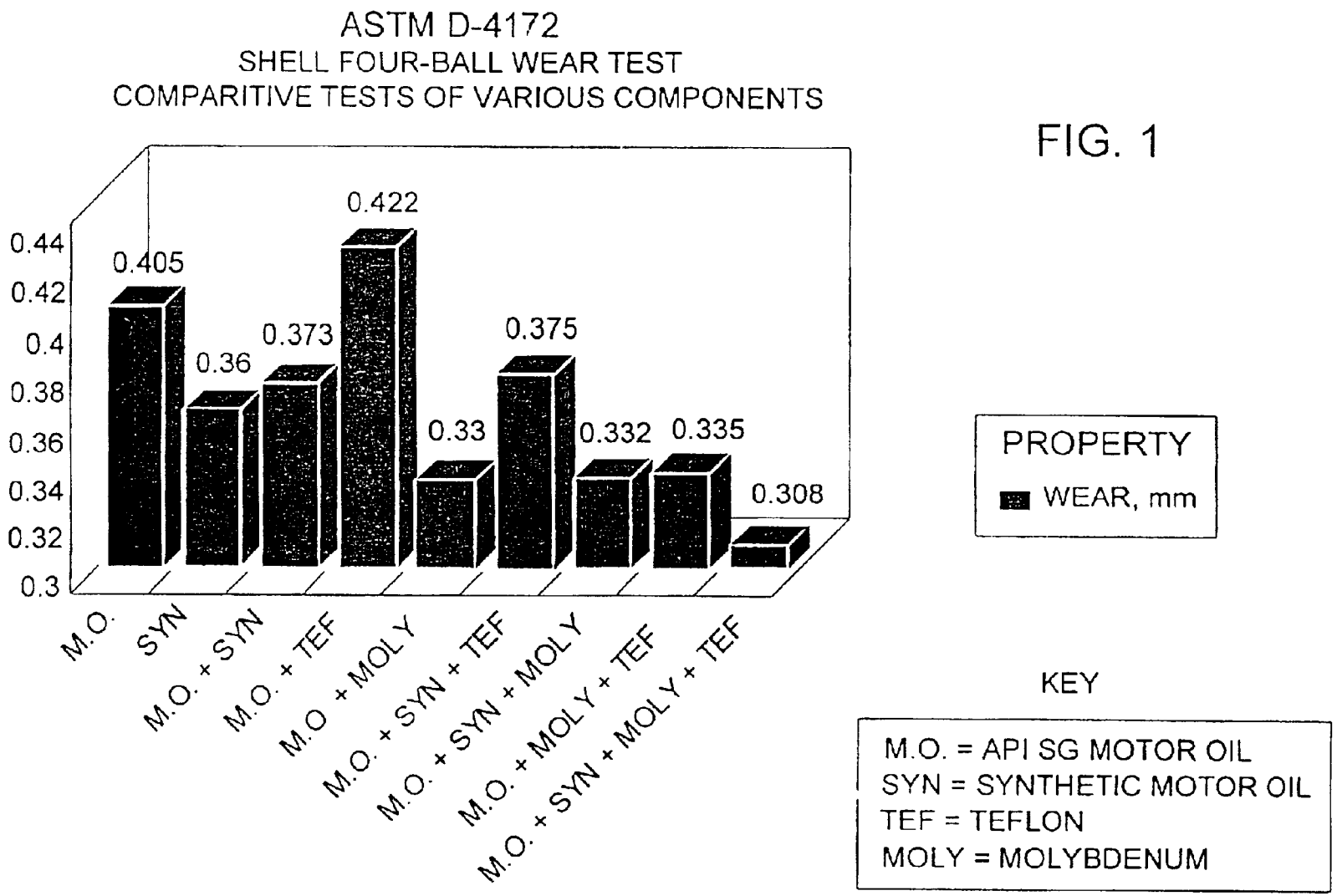
FIG. 1 is a bar chart of ASTM D4172 four-ball wear results versus lube compositions.

Each of the preferred ingredients of the engine treatment oil additive formulation, whether mandatory or optional, is discussed below:

Oil Base Stocks

The complete motor oil formula and/or the concentrated additive contains preferably up to 95 percent by volume, more preferably from about 10 to about 95 percent by volume, more preferably from about 25 to about 90 percent by volume, more preferably from about 40 to about 85% by volume, and most preferably from about 55 to 75 percent by volume of a base stock composed of a mineral oil base stock, a severely hydrotreated oil base stock, and/or a synthetic base alone or blended together, and/or the following base stocks defined as Group I (solvent refined mineral oils), Group II (hydro cracked mineral oils), Group III (severely hydro cracked oil); Group IV (polyolefins), and Group V (esters, and napthenes). Typically the base oils from Groups III, IV and V together with additives are deemed synthetic oils. As used in the instant application, oils from Group III are deemed severely hydro cracked (semi-synthetic) base oils.

Synthetic Base Stocks

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-octenes), poly(1-decenes), etc., and mixtures thereof; alkylbenzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.), alkylated diphenyl, ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g., methylpolyisopropylene glycol either having an average molecular weight of 1000, diphenyl either of polyethylene glycol have a molecular weight of 500–1000, diethyl ether of polypropylene glycol having a molecular weight of 1000–1500, etc.) or mono- and polycarboxylic esters thereof, for example, the acetic acid esters, mixed $C_3$—C—$_8$ fatty acid esters, esters, or the $C_{13}$0x0 acid diester of tetraethylene glycol.

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, alkenyl malonic acids, etc.) with a variety of alcohols (e.g., butyl alcohol, hexyl alcohol, dodecyl alcohol, 2-ethylhexyl alcohol, ethylene glycol diethylene glycol monoether, propylene glycol, etc.). Specific examples of these esters include dibutyl adipate, di(2-ethylhexyl) sebacate, di-hexyl fumarate, dioctyl sebacate, diisooctyl azelate, diisodecyl azealate, dioctyl phthalate, didecyl phthalate, dicicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc. Other synthetic oils include liquid esters of phosphorus-containing acids (e.g. tricresyl phosphate, trioctyl phosphate, diethyl ester of decylphosphonic acid, etc.), polymeric tetrahydrofurans and the like.

The concentrate additive and/or complete motor oil contains preferably up to 95 percent by volume, more preferably from about 10 to about 95 percent by volume, more preferably from about 25 to about 90 percent by volume, more preferably from about 40 to about 85% by volume, and most preferably from about 55 to 75 percent by volume of a synthetic, Group III severely hydro cracked (semi-synthetic), and/or mineral oil base stock used alone or blended together as a base stock.

One preferred synthetic base stock comprises at least a significant portion of a polyalphaolefin.

Polyalphaolefin (PAO)

Although not essential, the preferred synthetic base stock comprises at least a significant portion of a polyalphaolefin. Polyalphaolefin, ("PAO"), is a synthetic fluid effective at high temperatures, such as occurs during operation of internal combustion engines. It is also very effective at low temperatures. It is especially effective in the presence of diesters. Polyalphaolefin provides superior oxidation and hydrolytic stability and high film strength. Polyalphaolefin also has a high molecular weight, higher flash point, higher fire point, lower volatility, higher viscosity index, and lower pour point than mineral oil. U.S. Pat. No. 4,859,352 hereby incorporated by reference provides additional polyalphaolefin derivatives.

Preferred polyalphaolefins, ("PAO"), include those sold by EXXON-MOBIL USA as SHF fluids and those sold by Ethyl Corporation under the name ETHYLFLO, or ("ALBERMARLE"). PAO's include the ETHYL-FLOW series by Ethyl Corporation, "Albermarle Corporation", including ETHYL-FLOW 162, 164, 166, 168, and 174, having varying viscosities from about 2 to about 460 centistoke. Also useful are blends of about 56% of the 460 centistoke product and about 44% of the 45 centistoke product as set forth in U.S. Pat. No. 5,348,668 hereby incorporated by reference.

MOBIL SHF-42 from EXXON-MOBIL USA, EMERY 3004 and 3006, Equilon, and Quantum Chemical Company provide additional polyalphaolefins base stocks. For instance, EMERY 3004 polyalphaolefin has a viscosity of 3.86 centistokes (cSt) at 212 F. (100 C.) and 16.75 cSt at +104 F. (40 C.). It has a viscosity index of 125 and a pour point of −98 F. and it also has a flash point of +432 F. and a fire point of +478 F. Moreover, EMERY 3006 polyalphaolefin has a viscosity of 5.88 cSt at +212 F. and 31.22 cSt at +104 F. It has a viscosity index of 135 and a pour point of −87 F. It also has a flash point of +464 F. and a fire point of +514 F.

Additional satisfactory polyalphaolefins are those sold by Uniroyal Inc. under the brand SYNTON PAO-40, which is a 40 centistoke polyalphaolefin. Also useful are the ORONITE brand polyalphaolefins manufactured by CHEVRON-TEXACO Chemical Company.

It is contemplated that GULF SYNFLUID 4 cSt PAO, commercially available from Gulf Oil Chemicals Company, a subsidiary of CHEVRON-TEXACO Corporation, which is similar in many respects to EMERY 3004 may also be utilized herein. MOBIL SHF-41 PAO, commercially available from EXXON-MOBIL Chemical Corporation, is also similar in many respects to EMERY 3004.

Preferably the polyalphaolefins will have a viscosity of up to 100 centistoke and more typically in the range of about 2–10 centistoke at 100° C. with viscosities of 4 and 6 centistoke being particularly preferred.

Moreover, a preferred embodiment may incorporate up to 95 percent by volume, more preferably from 10 to 90 percent by volume, and more preferably from about 40 to 85 percent by volume of polyalphaolefins having a viscosity of about 4 cSt at 100° C. such as is available from Ethyl Corporation under the trademark name of DURASYN 164.

A preferred concentrate embodiment may incorporate up to 85 percent by volume, more preferably from 5 to 85 percent by volume, more preferably from about 10 to 60 percent by volume, and most preferably from 10 to 30 percent by volume of polyalphaolefins having a viscosity of about 6 cSt at 100° C. such as is available from Ethyl Corporation under the trademark name of DURASYN 166.

Moreover, an even more preferred embodiment of the present invention further providing even more enhanced performance characteristics utilizes synthetics which include a specific portion comprising esters, polyesters, or combinations thereof. One preferred embodiment utilizes polyolefins as the synthetic base stock together with at least a portion comprising esters and/or polyesters.

Esters

The most preferred synthetic based oil ester additives are polyolesters and diesters such as di-aliphatic diesters of alkyl carboxylic acids such as di-2-ethylhexylazelate, di-isodecyladipate, and di-tridecyladipate, commercially available under the brand name EMERY 2960 by Emery Chemicals, described in U.S. Pat. No. 4,859,352 to Waynick. Other suitable polyolesters are manufactured by EXXON-MOBIL Oil. Exxon-Mobil polyolester P-43, NP343 containing two alcohols, and Hatco Corp. 2939 are particularly preferred.

Diesters and other synthetic oils have been used as replacements of mineral oil in fluid lubricants. Diesters have outstanding extreme low temperature flow properties and good residence to oxidative breakdown.

The diester oil may include an aliphatic diester of a dicarboxylic acid, or the diester oil can comprise a dialkyl aliphatic diester of an alkyl dicarboxylic acid, such as di-2-ethyl hexyl azelate, di-isodecyl azelate, di-tridecyl azelate, di-isodecyl adipate, di-tridecyl adipate. For instance, Di-2-ethyl hexyl azelate is commercially available under the brand name of EMERY 2958 by Emery Chemicals.

Also useful are polyol esters such as EMERY 2935, 2936, and 2939 from Emery Group of Henkel Corporation and HATCO 2352, 2962, 2925, 2938, 2939, 2970, 3178, and 4322 polyol esters from Hatco Corporation, described in U.S. Pat. No. 5,344,579 to Ohtani et al. and MOBIL ester P 24 from EXXON-MOBIL USA. EXXON-MOBIL esters such as made by reacting dicarboxylic acids, glycols, and either monobasic acids or monohydric alcohols like EMERY 2936 synthetic-lubricant base stocks from Quantum Chemical Corporation and MOBIL P 24 from EXXON-MOBIL USA can be used. Polyol esters have good oxidation and hydrolytic stability. The polyol ester for use herein preferably has a pour point of about −100° C. or lower to −40° C. and a viscosity of about 2–460 centistoke at 100° C.

Although not essential, a preferred additive concentrate and/or motor oil comprises at least a portion of a ester. The concentrate additive and/or complete motor oil contains preferably up to 25 percent by volume, more preferably from about 5 to about 20 percent by volume, more preferably from about 5 to about 15 percent by volume, of a polyester or diester such as obtained from EMERY under the trademark 2960.

Severely Hydro Cracked Oils

A hydrogenated oil is a mineral oil subjected to hydrogenation or hydrocracking under special conditions to remove undesirable chemical compositions and impurities resulting in a base oil having synthetic oil components and properties. Typically the hydrogenated oil is defined by the American Petroleum Institute (API) as a Group III petroleum based stock with a sulfur level less than 0.03 with saturates greater than or equal to 90 and a viscosity index of greater than or equal to 120 may optionally be utilized in amounts up to 95 percent by volume, more preferably from 5.0 to 50 percent by volume and more preferably from 20 to 40 percent by volume when used alone or in combination with a synthetic or mineral oil.

The hydrogenated oil may be used as the sole base oil component of the instant invention providing superior performance to conventional motor oils with no other synthetic oil base or mineral oil base or used as a blend with mineral oil and/or synthetic oil. An example of such an oil is YUBASE-4. Other suppliers include CHEVRON-TEXACO Company. A complete motor oil or an additive concentrate embodiment may incorporate up to 95 percent by volume, more preferably from 5 to 85 percent by volume of the semi-synthetic as the oil base stock. When used in combination with another conventional synthetic oil such as those containing polyolefins or esters, or when used in combination with a mineral oil, the hydrogenated oil may be present in an amount of up to 95 percent by volume, more preferably from about 10 to 80 percent by volume, more preferably from 20 to 60 percent by volume and most preferably from 10 to 30 percent by volume of the base oil composition.

More particularly, the hydrogenated oil is a base oil for a lubricating oil consisting of a mineral oil and/or a synthetic oil, having a viscosity index of at least 120, and having a viscosity of from 2 to 3,000 CST at 100 degrees C. Hydrogenated oils can be obtained by subjecting raw materials for lubricating oils to hydrogenation treatment, using a hydrogenation catalyst such as cobalt or molybdenum with a silica-alumina carrier, and lubricating oil factions which can be obtained by the isomerization of waxes. The hydro cracked or wax-isomerized oils contain 90 percent by weight or greater of saturates and 300 ppm or less of sulfur.

Mineral Oil Base Stock

Although not essential, a mineral oil base stock may be incorporated in the present invention as a portion of the concentrate or a base stock to which the concentrate may be added to produce a motor oil. Particularly preferred as mineral oil base stocks are the ASHLAND 325 Neutral defined as a solvent refined neutral having a SABOLT UNIVERSAL of 325 SUS @ 100° F. and ASHLAND 100 Neutral defined as a solvent refined neutral having a SABOLT UNIVERSAL of 100 SUS @ 100° F., manufactured by MARATHON ASHLAND PETROLEUM and by others.

Other acceptable petroleum-base fluid compositions include white mineral, paraffinic and MVI naphthenic oils having the viscosity range of about 20–400 Centistoke. Preferred white mineral oils include those available from WITCO Corporation, ARCO BP Chemical Company, PSI and PENRECO. Preferred paraffinic oils include API Group I and Group II oils available from EXXON MOBIL USA, Group II oils available from MOTIVA ENTERPRISES, LLC., and Group II oils available from CHEVRON EXXON Corp. Preferred MVI naphthenic oils include solvent extracted oils available from EQUILON ENTERPRISES and SAN JOAQUIN REFINING, hydro treated oils available form EQUILON ENTERPRISES, and naphthenic oils sold under the names HYDROCAL and CALSOL by CALUMET, and naphthenic oils such as are described in U.S. Pat. No. 5,348,668 to Oldiges.

Mineral oil base stock can comprise the entire base oil typically up to 95% by volume, more preferably 5–85 percent by volume, more preferably 50–80 percent by volume and most preferably 70–80 percent by volume in the complete motor oil, but is not narrowly critical. More particularly, the mineral oil base stock can be used up to about 95 percent in the concentrate and up to 50 percent and preferably up to about 35 percent by volume of the motor engine oil upon dilution. Typically one unit of the concentrate is diluted with about 4 or 5 units of the motor oil which may be a fully synthetic, mineral oil, or blend.

Dispersant Inhibitor (DI)

Though not narrowly critical, the Dispersant Inhibitor ("DI"), is exemplified by those which contain alkyl zinc dithiophosphates, succinimides, esters, or Mannich dispersant, calcium, magnesium, sodium sulfonates, phenates, phenolic and amine antioxidants, plus various friction modifiers such as sulfurized fatty acids. Dispersant inhibitors are readily available from Lubrizol, Ethyl, Oronite, a division of CHEVRON-TEXACO Chemical, and INFINEUM.

Generally acceptable are those commercial detergent inhibitor packages used in formulated engine oils meeting the API SH CD or higher performance specifications. Particularly preferred are dispersants such as LUBRIZOL 8955 having chemical and physical properties such as those described in U.S. Pat. No. 5,490,945 of the Lubrizol Corporation which is hereby incorporated by reference, ETHYL HITEC 1111 and 1131, and similar formulations available from INFINEUM, or Oronite, a division of CHEVRON-TEXACO Chemical.

An effective amount of an additive package which incorporates a dispersion inhibitor such as the one listed heretofore may also be utilized and include a conventional detergent and/or a corrosion inhibitor. Such an additive package may be utilized with or in substitution of a selected dispersion inhibitor or combinations thereof with each other and/or other dispersion inhibitors commercially available in an effective amount of up to 35 percent by volume, more preferably from about 0.5 to 25 percent by volume and more preferably from about 1 to 15 percent by volume of the complete motor oil formula and up to 6× that amount in the concentrate. The DI concentration is generally up to 15% by volume of the total formulation of the complete engine oil and more particularly from 5.0 to 15% by volume. Concentrations produced for dilution will generally be in these ranges.

Zinc dithiophosphate is a multi-function additive in that it functions as a corrosion inhibitor, antiwear agent, and antioxidants added to organic materials to retard oxidation.

Other metal dithiophosphates such as zinc isopropyl, methylamyl dithiophosphate, zinc isopropyl isooctyl dithiophosphate, barium di(nonyl) dithiophosphate, zinc di(cyclohexyl) dithiophosphate, copper di(isobutyl) dithiophosphate, calcium di(hexyl) dithiophosphate, zinc isobutyl isoamyl dithiophosphate, and zinc isopropyl secondary-butyl dithiophosphate may be applicable. These metal salts of phosphorus acid esters are typically prepared by reacting the metal base with the phosphorus acid ester such as set forth in U.S. Pat. No. 5,354,485 hereby incorporated by reference. Moreover, a preferred dispersion inhibitor is described in U.S. Pat. No. 5,490,945 hereby incorporated by reference which describes a compound containing at least one carboxylic derivative composition produced by reacting at least one substituted succinic acylating agent containing at least about 50 carbon atoms in the substituent with at least one amine compound containing at least one HN<group.

Pour Point Depressant

A pour point depressant in an effective amount of up to 10.0 volume percent of the complete engine oil formula and more preferably about 0.01 to 5.0 percent by weight and most preferably from about 0.1 to 1.0 percent by weight is not essential but can be utilized an embodiment of the formulation. Of course, a sufficient amount of the viscosity improver may also be incorporated in the base oils or motor oil to be treated. Also the pour point depressant is typically not concentrated 4× or 5× in the additive package. An example of a suitable pour point depressant is polymethacyrlate, alkylated bicyclic aromatics, styrene esters, polyfumerates, oligomerized alky phenols, dialkyl esters of phthalate acid, ethylene vinyl acetate copolymers, and other mixed hydrocarbon polymers from LUBRIZOL, the ETHYL Corporation, or ROHMAX, a Division of Degussa. A commercially available pour point depressant is sold under the brand name of ACRYLOID 3008 which is a polymethyrlate formula.

Additive Packages

Additive packages which incorporate a dispersion inhibitor with a conventional detergent and/or a corrosion inhibitor may also be utilized with or in substitution of the dispersion inhibitor. For instance as set forth heretofore, such an additive package may comprise Lubrizol's LZ8955 and/or LZ9802 or combinations thereof with each other and/or other dispersion inhibitors in an effective amount of up to 35 percent by volume, more preferably from about 0.5 to 25 percent by volume and more preferably from about 1 to 10 percent by volume of the concentrate.

Because the base oils typically contain an effective amount of a pour point depressant and/or the motor oil to which the additive is added typically contain an effective amount of a pour point depressant, it would not typically be concentrated 4× or 5× in the additive package.

Viscosity Index Improver (VI)

Viscosity improvers, ("VI"), include, but are not limited to, polyisobutenes, polymethacrylate acid esters, polyacrylate acid esters, diene polymers, polyalkyl styrenes, alkenyl aryl conjugated diene copolymers, polyolefins and multifunctional viscosity improvers and SHELLVIS 90, a linear styrene isoprene rubber in mineral oil base or SHELLVIS 260 a cyclic styrene isoprene compound.

The lubricant additive contain up to 15 percent by volume of a viscosity improver, more preferably from about 0.005–10 percent by volume, more preferably 0.05 to 8 and more preferably from 0.1 to 1.0 percent by volume. Of course, a sufficient amount of the viscosity improver may also be incorporated in the base oils or motor oil to be treated.

Molybdenum Additive

The most preferred molybdenum additive is an oil-soluble decomposable organo molybdenum compound, such as MOLYVAN 855 which is an oil soluble secondary diarylamine defined as substantially free of active phosphorus and active sulfur. The MOLYVAN 855 is described in Vanderbilt's Material Data and Safety Sheet as a organomolybdenum compound having a density of 1.04 and viscosity at 100° C. of 47.12 cSt. In general, the organo molybdenum compounds are preferred because of their superior solubility and effectiveness.

A less effective alternative molybdenum additive is MOLYVAN L is sulfonated oxymolybdenum dialkyldithiophosphate described in U.S. Pat. No. 5,055,174 by Howell hereby incorporated by reference.

MOLYVAN A made by R.T. Vanderbilt company, Inc., New York, N.Y., USA, is also an alternative additive which contains about 28.8 wt. % MO, 31.6 wt. % C, 5.4 wt. % H., and 25.9 wt. % S. Also useful are MOLYVAN 855, 822, 856, and 807 in decreasing order of preference.

Also useful is SAKURA LUBE-500, which is more soluble Mo dithiocarbamate containing lubricant additive obtained from Asahi Denki Corporation and comprised of about 20.2 wt. % MO, 43.8 wt. % C, 7.4 wt. % H, and 22.4 wt. % S.

Also useful is MOLYVAN 807, a mixture of about 50 wt. % molybdenum ditridecyldithyocarbonate, and about 50 wt. % of an aromatic oil having a specific gravity of about 38.4 SUS and containing about 4.6 wt. % molybdenum, also manufactured by R. T. Vanderbilt and marketed as an antioxidant and antiwear additive.

Other sources are molybdenum $Mo(Co)_6$, and Molybdenum octoate, $MoO(C_7H_{15}CO_2)_2$ containing about 8 wt-% Mo marketed by Aldrich Chemical Company, Milwaukee, Wis. and molybdenum naphthenethioctoate marketed by Shephard Chemical Company, Cincinnati, Ohio.

Inorganic molybdenum compounds such as molybdenum sulfide and molybdenum oxide are substantially less preferred than the organic compounds as described in 855, 822, 856, and 807.

Whereas 1% is equal to 10,000 parts per million (ppm), the preferred dosage in the molybdenum additive is up to 5.0 percent by mass. More preferably the preferred dosage is up to 3,000 ppm by mass, more preferably from about 100 ppm to about 2,000 ppm by mass, more preferably from about 300 to about 1,500 ppm by mass, more preferably from 300 to about 1000 ppm by mass of molybdenum.

Polytetraflouroethylene Additive

Polytetrafluoroethylene sold commercially under the trademark of TEFLON by the DUPONT Corporation. It is a solid lubricant which can be defined as an oil soluble functional additive. The term "oil soluble" water-insoluble functional additive refers to a functional additive which is not soluble in water above a level of about 1 gram per 100 ml of water at 25° C., but is soluble in mineral oil to the extent of at least 1 gram per liter at 25° C.

These functional additives can also include frictional polymer formers, which are polymer forming materials which are dispersed in a liquid carrier at low concentration and which polymerize at rubbing or contacting surfaces to form protective polymeric films on the surfaces. The polymerization are believed to result from the heat generated by the friction and, possibly, from catalytic and/or chemical action of the freshly exposed surface.

It is theorized that polytetrafluoroethylene, ("PTFE"), containing lubricants provide enhanced lubrication by virtue of the fact that the PTFE particles somehow become attached to the surfaces of the engine thus lubricated, thereby creating a renewable coating of PTFE. The composition may contain a mixture of a carrier lubricant medium, such as mineral oil, a quantity of fluoropolymer particles, such as ground and sintered particles of polytetrafluoroethylene which are well dispersed in the carrier lubricant. It is important that these particles are well dispersed in the carrier lubricant in order to prevent coagulation, agglomeration, and/or settling.

The size of the PTFE particles is selected based on the consideration that the PTFE particles may actually become attached within the pores of the surface thus coated. The frictional forces applied by the moving parts of the engine wipe after the composition is applied to it removing excess lubricant and working the lubricant into the surface by the exertion of heat and pressure to the surface to enhance penetration of the lubricant into the surface. Thus, it is thought that the PTFE may become attached to the surface, and particularly within the pores of the surface.

It is thought that the other additives in the additive package aid in bonding of the PTFE particles to the surface lowering the coefficient of friction of the surface and reducing fluid drag on the surface.

The PTFE for use with selected embodiments of the present invention are preferably a nonaqueous dispersion of fine particles in colloidal form. A preferred average particle size would be in the range of from about 0.05–3.0 micrometers (microns) and can be in any convenient nonaqueous media; e.g., synthetic or mineral base oil, compatible with the remainder of the formulation. Commercial PTFE dispersions which are suitable for the invention include ACHINSON SLA 1612 manufactured by Acheson Colloids Company, Michigan.

The preferred dosage of PTFE in the selected concentrate additive is up to 10.0 percent by weight, preferably from about 0.01 to about 10 weight percent, more preferably from about 0.05 to about 5 weight percent, and most preferably from about 0.01–3 weight percent PTFE.

Anti-wear Extreme Pressure Agents

The preferred anti-wear extreme pressure agent is a boron antiwear/extreme pressure agent, preferably a borate ester, a boric acid, other boron compounds such as a boron oxide. The boron compound is hydrolytically stable and is utilized for improved antiwear, antiweld, extreme pressure and/or friction properties, and perform as a rust and corrosion inhibitor for copper bearings and other metal engine components. The borated ester compound acts as an inhibitor for corrosion of metal to prevent corrosion of either ferrous or non-ferrous metals (e.g. copper, bronze, brass, titanium, aluminum and the like) or both, present in concentrations in which they are effective in inhibiting corrosion.

Patents describing techniques for making basic salts of sulfonic, carboxylic acids and mixtures thereof include U.S. Pat. Nos. 5,354,485; 2,501,731; 2,616,911; 2,777,874; 3,384,585; 3,320,162; 3,488,284; and 3,629,109. The disclosure of these patents are hereby incorporated by reference. Methods of preparing borated overbased compositions are found in U.S. Pat. Nos.: 4,744,920; 4,792,410; and PCT publication WO 88/03144. The disclosure of these references are hereby incorporated by reference. The oil-soluble neutral or basic salts of alkali or alkaline earth metals salts may also be reacted with a boron compound.

The borate ester utilized in the preferred embodiment is manufactured by EXXON-MOBIL USA under the product designation of ("MCP 1286") and MOBIL ADC700. Test data show the viscosity at 100° C. using the D-445 method is 2.9 cSt; the viscosity at 40° C. using the D-445 method is 11.9; the flash point using the D-93 method is 146; the pour point using the D-97 method is −69; and the percent boron as determined by the ICP method is 5.3%.

The preferred dosage of boron compound in the total crankcase lubricant is up to 10.0 volume percent, more preferably from about 0.01 to about 10.0 volume %, more preferably from about 0.01 to about 5 volume %, and most preferably from about 0.1–3.0 volume %. An effective elemental boron range of up to 1000 ppm or less than 1% elemental boron. Thus, a preferred concentration of elemental boron is from 100 to 1000 ppm and more preferably from 100 to 300 ppm and most preferably in one preferred embodiment as set forth in Table 3 about 166 ppm.

Figure 6:
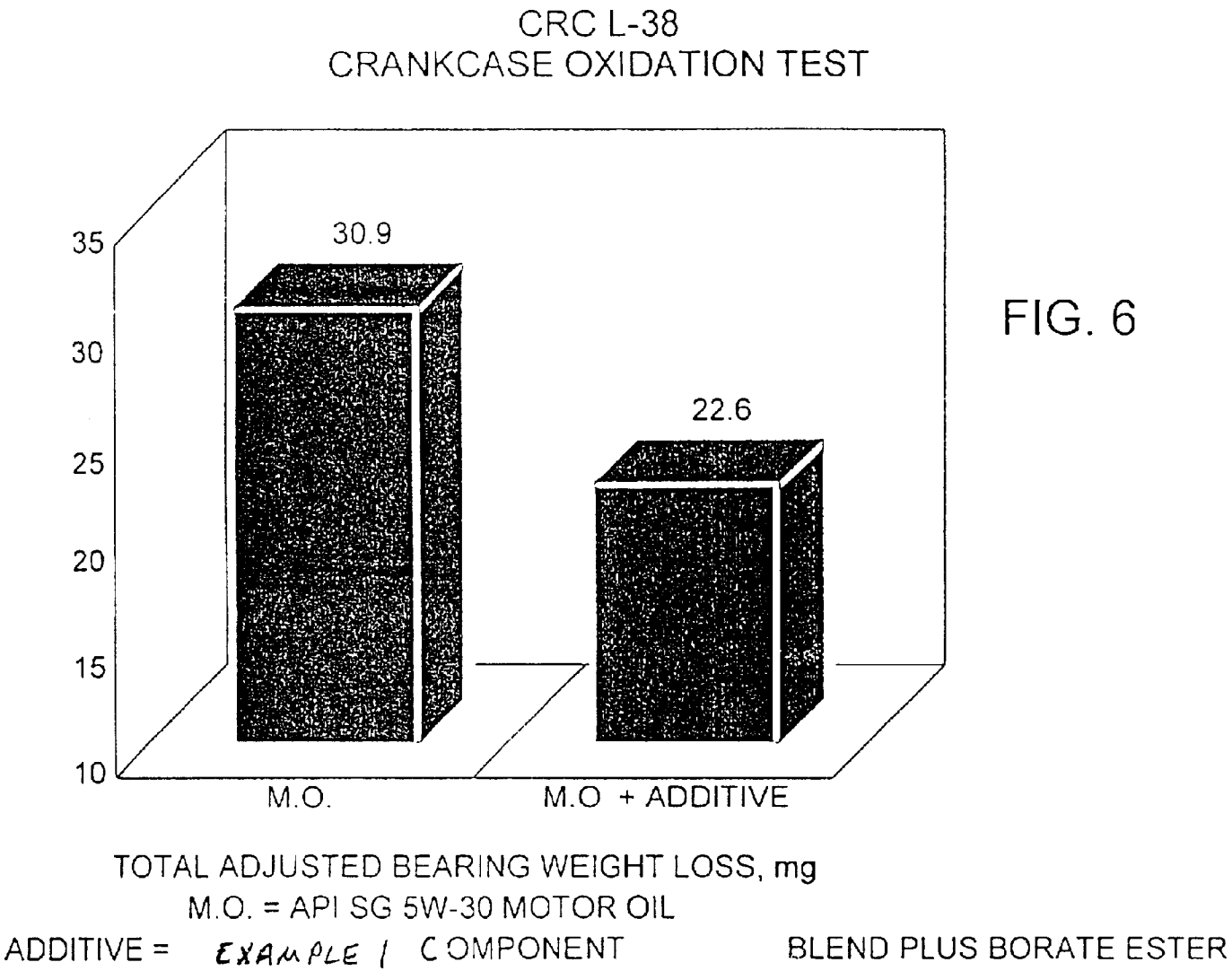
FIG. 6 graphs CRC L-38 Crankcase Oxidation Test and shows a 36.7% improvement from using the additive defined by Example 1 of the present invention including a boron agent.

As demonstrated in FIG. 6, the engine treatment oil additive formulation was found to comply with all requirements of engine additives specification CRC L-38 for a Crankcase Oxidation Test showing the Total Adjusted Bearing Weight Loss comparing the blend of Components comprising the engine treatment oil additive with an API SG 5w-30 Motor Oil. The surprisingly good results show the total adjusted bearing weight loss was reduced from 30.9 mg for the Motor Oil without the engine treatment oil additive to 22.6 mg. for the motor oil used in combination with the engine treatment oil additive.

Other corrosion resisting compounds which may be used together with boron or independently may be selected from the group comprising dimercapto, thiediapoles, and benzotriazoles, benzotriazole derivatives, benzothiazole, benzothiazole derivatives, triazole, triazole derivatives, benzoimidazole, and benzoiidazole derivitives in levels of to 1% by weight.

Other Additives

The invention also contemplates the use of an effective amount of other additives in the lubricating and functional fluid compositions of this invention. Such additives include, for example, detergents and dispersants of the ash-producing or ashless type, corrosion and oxidation-inhibiting agents, pour point depressing agents, auxiliary extreme pressure and/or antiwear agents, color stabilizers and anti-foam agents.

Experimental Results

The novel engine treatment oil additive comprises a combination of chemical constituents including an oil soluble molybdenum additive, polyalphaolefin, ester such as a polyolester or diester, dispersant inhibitor containing zinc dithiophosphate, and viscosity index improvers. A polytetrafluoroethylene compound increases the effect of the other chemical constituents considerably. A borate ester may also be incorporated in the blend with or without the polytetrafluoroethylene additive providing an even greater improvement in the oxidation inhibition capabilities thereof. The blend is typically used in combination with a conventional crankcase lubricant such as a mineral oil, synthetic, or mineral/oil synthetic blend at about a 20 to about a 25% volume/percent. The improved performance of the engine additive in comparison with conventional mineral oil crankcase lubricants is attributable to optimizing the design parameters for each of the individual chemical constituents and combining the chemical constituents according to the present invention to obtain surprisingly good results including improved: wear, oxidation resistance, viscosity stability, engine cleanliness, fuel economy, cold starting, and inhibition of acid formation. The novel engine additive formulation comprises a combination of compounds, ingredients, or components, each of which alone is insufficient to give the desired properties, but when used in concert give outstanding lubricating properties.

It is theorized that the combination of chemical constituents comprising the instant invention result in a reduction of friction between the moving parts of the engine so that in operation an extremely fine film of the chemical constituents is formed on the metal surfaces. At the high temperature and high pressure within the engine, the surface active ingredients react with the film continuously forming an extremely thin lubricating layer thereon having an extremely low coefficient of friction and wear even under extreme temperature and pressure providing superior lubrication during the start-up and running phase of the engine.

Experimental Evaluation

The following Examples provide the results of tests performed comparing the combination of formula components of the present invention with conventional API SG motor oil. The Examples exemplify the technology previously described. The combination of the formula components in the Examples provide excellent performance at high temperatures while also maintaining excellent performance at moderately elevated temperatures and normal temperatures, as well as provide resistance to ferrous and copper corrosion, improved wear, oxidation resistance, viscosity stability, engine cleanliness, fuel economy, cold starting, inhibition of acid formation, and other desirable high performance properties greater than exhibited by the individual components.

EXAMPLE 1

The Invention Using Mo. Synthetic, PTFE, DI and VI Additive

The additive package is designed for addition to conventional motor oil in the crankcase of an internal combustion engine is prepared in a 2000 gallon jacketed, stirred vessel heated to approximately 40° C. First there is added 600 gallons of polyalphaolefins (PAO 4 cSt) obtained from Ethyl Corporation under the trademark DURASYN 164; 43 gallons of PAO 6 centistoke DURASYM 166 obtained from the same source and 93 gallons of diester obtained under the brand name EMERY 2960. Stirring continues during the addition of all the ingredients. The above mixture is termed "synthetic" and is a synthetic base stock. To the synthetic is added 123 gallons of dispersant inhibitor (DI) package obtained under the brand name LUBRIZOL 8955, Lubrizol Corporation; 5 gallons of an 8% concentrate of SHELL VIS 1990 viscosity index improver, 25 gallons of MOLYVAN 855 obtained from R. T. Vanderbilt and Company, and 52 gallons of SLA 1612 obtained from Acheson Colloids, a 20% concentration of colloidal DUPONT TEFLON® brand PTFE. The resulting mixture is stirred for an additional 30 minutes, sampled and tested for viscosity, metal concentration, and other quality control checks.

The resulting concentrate is bottled into one quart containers and a single container is added to the four quarts of conventional motor oil in a five quart crank case of an automobile.

Figure 2:
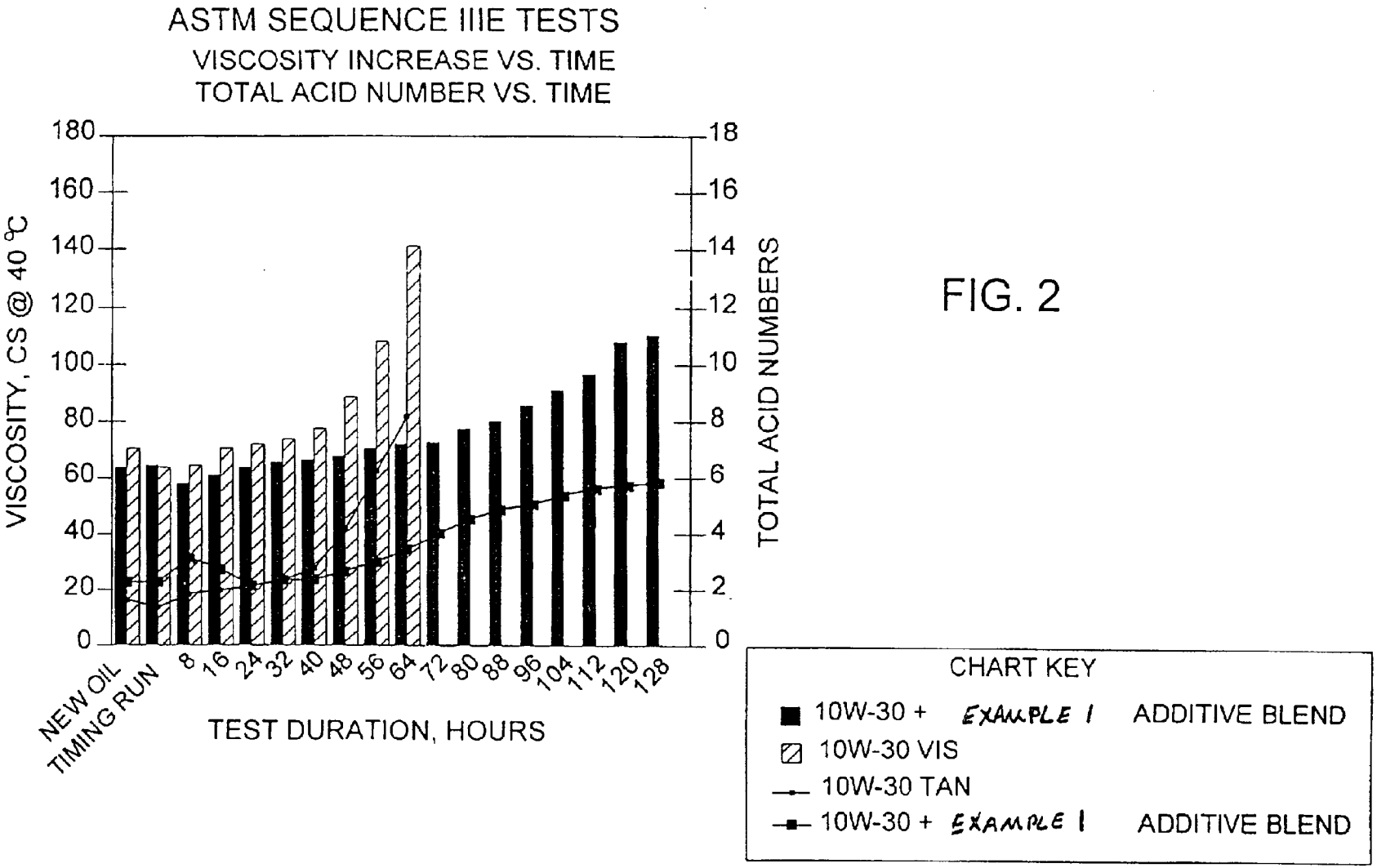
FIG. 2 is a multiple parameter graph of base oil compared to adiditized oil showing viscosity increase and acid number increase versus time in ASTM Sequence IIIE tests wherein the additive defined in Example 1 contains PTFE, but not a boron agent.
Figure 3:
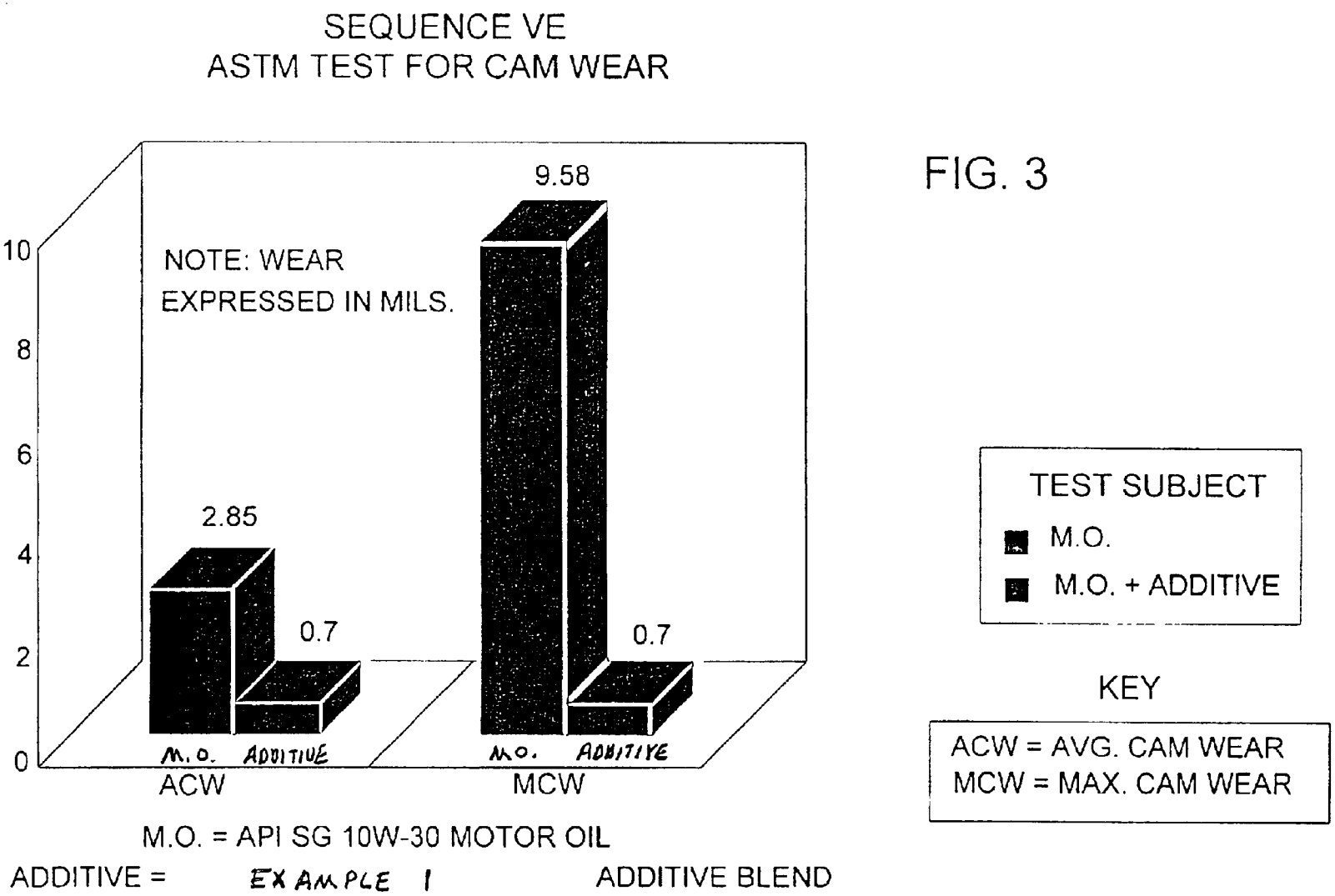
FIG. 3 graphs ASTM Sequence VE test results of average (and maximum) cam wear for oil including the additive of the present invention defined in Example 1 containing PTFE, but not a boron agent, versus conventional motor oil.
Figure 4:
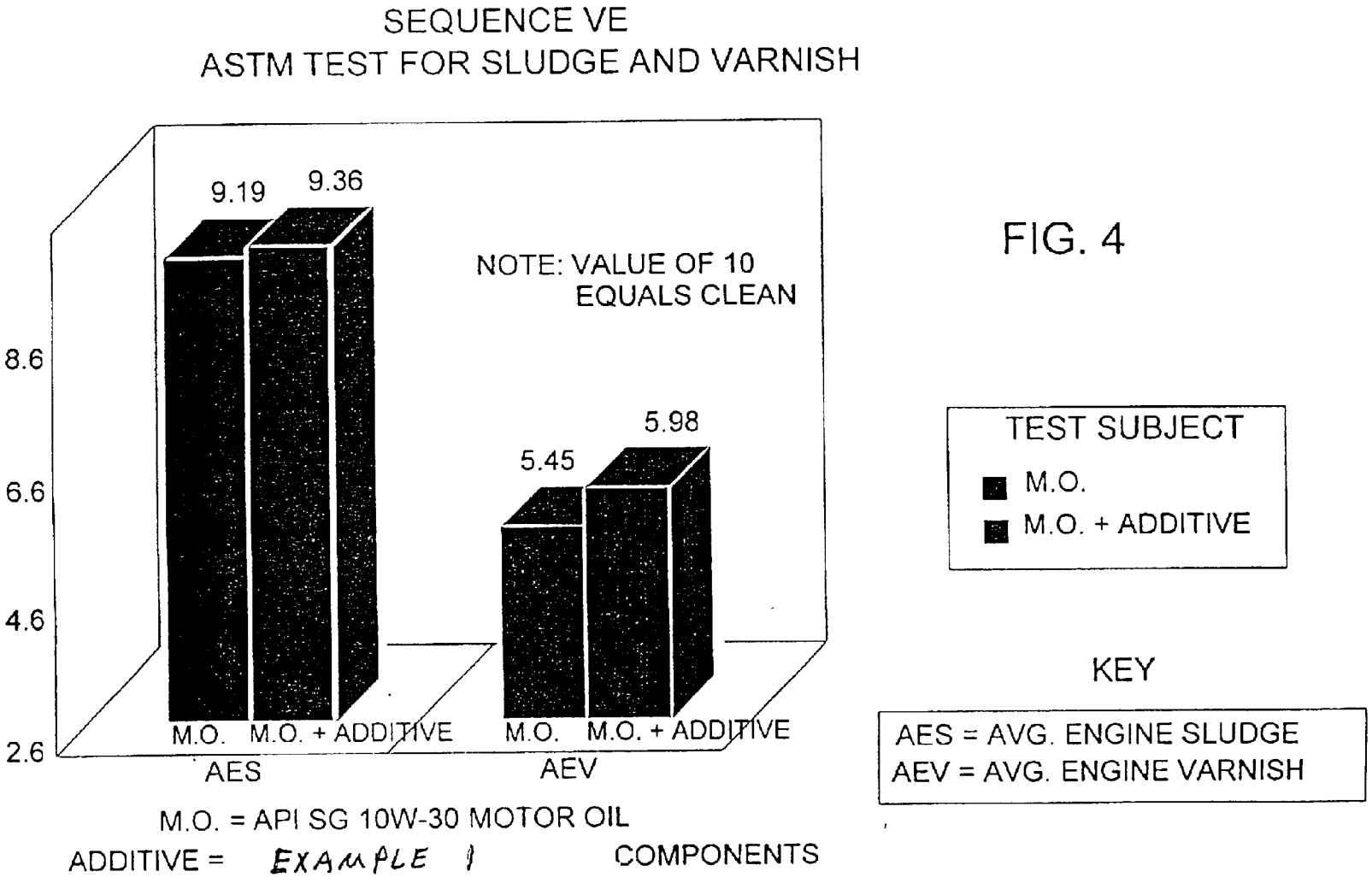
FIG. 4 graphs the substantial improvement in engine cleanliness in the Sequence VE test for the oil including the additive defined in Example 1 of the present invention containing PTFE, but not a borate agent, versus conventional motor oil.
Figure 5:
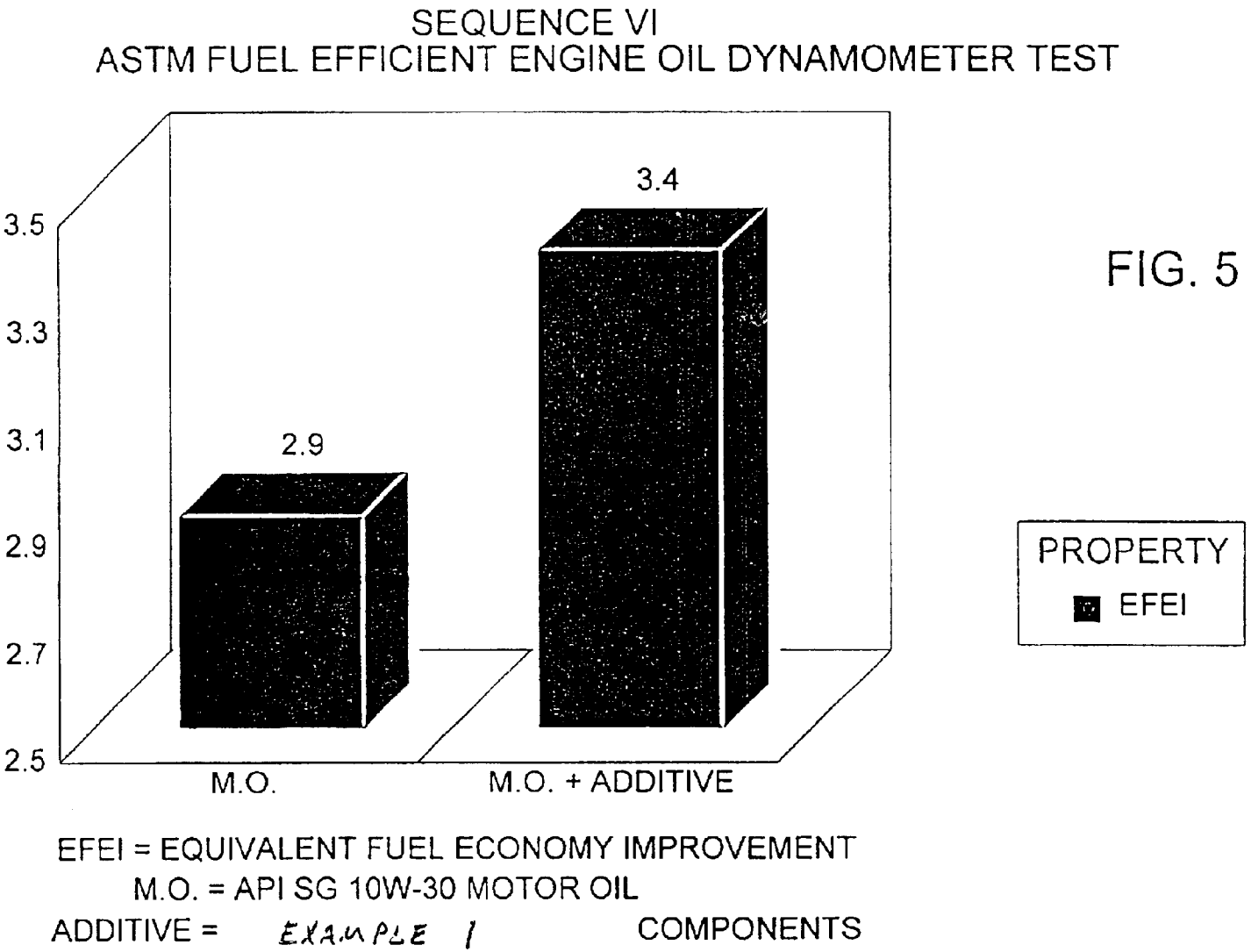
FIG. 5 graphs ASTM Sequence VI fuel economy and shows 17% improvement when using the additive defined by Example 1 of the present invention containing PTFE, but not a boron agent.

The result is improved wear (FIGS. 1 and 3), oxidation resistance (FIG. 2), viscosity stability (FIG. 2), engine cleanliness (FIG. 4), fuel economy (FIG. 5), cold starting (Table 2, and inhibited acid formation (FIG. 2).

EXAMPLE 2

The Invention of Example 1 Under Standard Tests

When one of the one quart formulations prepared in Example 1 is tested under conventional lubricant test procedures, results are as given in Tables 1 and 2, and FIGS. 1–5. Note that the Shell four-ball wear test ASTM D4172 of FIG. 1 and Table 1 is a bench test indicative of wear performance of a lubricant.

When the same ingredients of Example 1 are formulated while omitting one or more of the ingredients, the comparative results are as shown in Table 1 and FIG. 1.

As can be seen from Tables 1 and 2, and FIGS. 1 through 5, the results using this additive show a remarkable improvement when compared to a conventional motor oil tested without the additive of the invention.

EXAMPLE 3

A grease composition according to the invention of Example 1 can be conventionally mixed with a lithium soap of a fatty acid to thicken the composition and to result in an improved grease

EXAMPLE 4

A boron containing compound, more particularly a borate ester was added to the additive produced in Example 1. As demonstrated in FIG. 6, the engine treatment oil additive formulation was found to comply with all requirements of engine additives specification CRC L-38 for a Crankcase Oxidation Test showing the Total Adjusted Bearing Weight Loss comparing the blend of Components comprising the engine treatment oil additive with an API SG 5w-30 Motor Oil. The surprisingly good results show the total adjusted bearing weight loss was reduced from 30.9 mg for the Motor Oil without the engine treatment oil additive to 22.6 mg. for the motor oil used in combination with the engine treatment oil additive.

As set forth herebelow, Table 3 shows various additive combinations and the preferred formulas by weight and/or volume percent.

TABLE 1

ASTM 4172 Shell Four Ball

| TEST | AC | SYN | AC + SYN | AC + TEF | AC + MOLY | AC + SYN + TEF | AC + SYN + MOLY | AC + MOLY + TEF | AC +SYN + MOLY + VI + DI* |
|---|---|---|---|---|---|---|---|---|---|
| Shell Four-Ball Wear, mm | 0.405 | 0.360 | 0.373 | 0.422 | 0.330 | 0.375 | 0.332 | 0.335 | 0.308 |

| | |
|---|---|
| MO | Motor Oils, VALVOLINE 10W30 All-Climate |
| SYN | VALVOLINE 5W30 Synthetic, includes DI and VI |
| AC + SYN | 10W30 AC + (20%) 5W30 Synthetic |
| MOLY | Molybdenum |
| TEF | TEFLON ® |
| ADDITIVE | Invention of Example 1 |

TABLE 2

ASTM 4742 - 88 Oxidation

| Sample | RFOUT (min)** | TFOUT (min)* | RULER*** | CCS @ 20°C. cP | TPI @ 20°F. cP |
|---|---|---|---|---|---|
| A | 180 | 138 | 211 | 3,030 | 12,540 |
| C | 370 | 279 | 322 | 2,160 | 9,360 |

Note
A 10W30 All Climate (Motor Oil Control)
*C 80% Control plus 20% Additive
**Thin Film Oxygen Uptake
***Modified test of ASTM 4742
Remaining useful Life Evaluation Routine

TABLE 3

ADDITIVE COMPOSITIONS

| Parameter | Units | Preferred | More Preferred | Most Preferred | Target Formulation Vol % |
|---|---|---|---|---|---|
| Base Stock | Vol % | Up to 95 | 25–90 | 60–85 | 74 |
| Polyolefins | Vol. % | 15–85 | 25–80 | 50–75 | 65 |
| Diesters | Vol % | 1–25 | 3–20 | 5–15 | 9.5 |
| Viscosity Improver 100% | Wt. % | 0.05–5 | 0.07–3 | 0.1–2 | 6.5 |
| Molybdenum (Mo) | Wt % | 0.05–5 | 0.07–3 | 0.1–2 | 2.5 |
| PTFE | Wt. % | 0.01–10 | 0.0005–5 | 0.1–3 | 20 |
| Dispersant (12.3% vol.) | Vol. % | 0.5–35 | 1–25 | 5–20 | 12.3 |
| Dilution Before Use. | Vol. Lubr Vol. Addit | 0.25 | 0.5–15 | 1–10 | 4–5 |
| Borate Esters | Vol. % | 0.01–1.0 | 0.05–7 | 0.1–.5 | 1 |
| | | 10–1000 ppm | 50–700 ppm | 10–500 ppm | 1000 ppm |

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

Reference to documents made in the specification is intended to result in such patents or literature cited are expressly incorporated herein by reference, including any patents or other literature references cited within such documents as if fully set forth in this specification.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

We claim:

1. An engine oil lubricant concentrate used in combination with a conventional crankcase lubricant comprising a mineral oil, a synthetic oil, a semi-synthetic severely hydro cracked oil, and combinations thereof, said lubricant concentrate consisting essentially of:

from 0.05 weight percent to 5.0 weight percent of an oil soluble molybdenum additive;

from 10.0 volume percent to 95 volume percent of a base oil comprising a synthetic base oil, a mineral oil, a severely hydro cracked oil, and combinations thereof;

from 0.5 volume percent to 35.0 volume percent of a dispersant inhibitor containing zinc dithiophosphate;

from 0.5 weight percent to 25.0 weight percent of a viscosity index improver; and a boron compound containing an effective amount of less than 1000 ppm of an elemental boron.

2. An engine oil lubricant concentrate used in combination with a conventional crankcase lubricant comprising a mineral oil, a synthetic oil, a semi-synthetic severely hydro cracked oil, and combinations thereof, said lubricant concentrate consisting essentially of:

from 0.05 weight percent to 5.0 weight percent of an oil soluble molybdenum additive;

from 10.0 volume percent to 95 volume percent of a synthetic base oil, a mineral oil, a severely hydro cracked oil, and combinations thereof;

from 0.5 volume percent to 35.0 volume percent of a dispersant inhibitor;

from 0.5 weight percent to 25.0 weight percent of a viscosity index improver; and a boron compound comprising from 0.01 volume percent to 1.0 volume percent of an elemental boron.

3. The lubricant concentrate according to claim 2, wherein said synthetic base oil comprises from 10.0 volume percent to 95 volume percent of an ester.

4. The lubricant concentrate according to claim 2, wherein said synthetic base comprises from 10.0 volume percent to 95 volume percent of a diester.

5. The lubricant concentrate according to claim 2, wherein said synthetic base stock comprises from 10.0 volume percent to 95 volume percent of a polyalphaolefin.

6. The lubricant concentrate according to claim 2, wherein said synthetic oil comprises from 10.0 volume percent to 95 volume percent of a polyalphaolefin in combination with an ester.

7. The lubricant concentrate according to claim 2, comprising from 1.0 to 3.0 weight percent of said oil soluble molybdenum additive.

8. The lubricant concentrate according to claim 2 wherein said synthetic base stock comprises at least 10% polyalphaolefins.

9. The lubricant concentrate according to claim 2, said dispersant inhibitor containing zinc dithiophosphate.

10. The lubricant concentrate according to claim 2, wherein said viscosity index improver is selected from the group consisting of polyisobutenes, polymethacrylate acid esters, polyacrylate acid esters, diene polymers, polyalkyl styrenes, alkenyl aryl conjugated diene copolymers, polyolefins, and combinations thereof.

11. The lubricant concentrate of claim 2, wherein said diester is a di-aliphatic diesters of alkyl carboxylic acid.

12. The lubricant concentrate of claim 11, wherein said di-aliphatic diesters of alkyl carboxylic acid is selected from the group consisting of di-2-ethylhexylazelate, di-isodecyladipate, and di-tridecyladipate.

13. The lubricant concentrate of claim 3, wherein said ester has a pour point of less than −100° C. and a viscosity of from 2 to 460 centistoke at 100° C.

14. The lubricant of concentrate of claim 2, wherein said base oil is a combination of a mineral oil and a severely hydro cracked oil.

15. The lubricant concentrate of claim 2, wherein said base oil is a synthetic oil.

16. The lubricant concentrate of claim 5, wherein said polyalphaolefin is has a viscosity of from 2 to 460 centistoke.

17. The lubricant concentrate of claim 5, wherein said polyalphaolefin has a viscosity of from 2 to 10 centistoke at 200° C.

18. The lubricant concentrate of claim 5, wherein said polyalphaolefin has a viscosity of from 4 to 6 centistoke at 200° C.

19. The lubricant concentrate of claim 2, wherein said synthetic base stock comprises from 25 to 90 percent by volume.

20. The lubricant concentrate of claim 2, wherein said synthetic base stock comprises from 60 to 85 percent by volume.

21. The lubricant concentrate of claim 2, wherein said viscosity index improver constitutes from 0.05 to 5.0 weight percent thereof.

22. The lubricant concentrate of claim 2, wherein said viscosity index improve constitutes from 0.07 to 3.0 weight percent thereof.

23. The lubricant concentrate of claim 2, wherein said viscosity index improver constitutes from 0.1 to 2.0 weight percent thereof.

24. The lubricant concentrate of claim 2, wherein said oil soluble molybdenum additive is an organo molybdenum compound.

25. The lubricant concentrate of claim 24, wherein said organo molybdenum compound comprises a sulfonated oxymolybdenum dialkyldithiophosphate, sulfide molybdenum dithiophosphate, and combinations thereof.

26. The lubricant concentrate of claim 2, wherein said oil soluble molybdenum is present in an amount of from 0.1 to 3.0 weight percent thereof.

27. The lubricant concentrate of claim 2, wherein said oil soluble molybdenum additive is an inorganic molybdenum compound.

28. The lubricant concentrate of claim 27, wherein said inorganic molybdenum compound further comprises a molybdenum sulfide, a molybdenum oxide, and combinations thereof.

29. The lubricant concentrate of claim 2, said wherein said dispersant inhibitor comprises an alkyl zinc dithiophosphate, a succinimide, a Mannich dispersants, and combinations thereof.

30. The lubricant concentrate of claim 2, further including an effective amount of up to 10.0 percent by weight of a nonaqueous polytetrafluoroethylene.

31. The lubricant concentrate of claim 2, wherein said dispersant inhibitor comprises from 1.0 to 25.0 by volume thereof.

32. The lubricant concentrate of claim 2, wherein said dispersant inhibitor comprises from 5.0 to 20.0 by volume thereof.

33. A lubricating composition comprising a major amount of an oil of lubricating viscosity and a minor amount of the lubricant concentrate of claim 2.

34. A lubricating composition comprising a major amount of an oil of lubricating viscosity and a minor amount of the lubricant concentrate of claim 30.

35. A lubricating composition comprising a major amount of a grease of lubricating viscosity and a minor amount of the lubricant concentrate of claim 2.

36. A lubricating composition comprising a major amount of a grease of lubricating viscosity and a minor amount of the lubricant concentrate of claim 30.

37. The lubricant concentrate of claim 2, wherein said boron compound is a borate ester.

38. A process of manufacturing an improved lubricating composition additive comprising the steps of mixing together at about 0–100° C.:

a. about 0.35–15 wt. % of oil soluble molybdenum additive;

b. about 0.25–25 wt. % conventional and/or synthetic motor oil or grease;

c. about 0–90 vol. wt. % of a base oil comprising a synthetic oil, a mineral oil, a severely hydro cracked semi-synthetic oil, and combinations thereof;

d. about 0–15 wt. % of viscosity index improver; and e. a boron compound containing up to 1.0 percent of elemental boron;

said lubricant concentrate, when diluted with about 0.5–15 parts of said motor oil in a crankcase of an internal combustion engine, providing that engine with improved wear reduction, fuel economy and viscosity stability.

* * * * *